US006151938A

United States Patent [19]

Park et al.

[11] Patent Number: 6,151,938

[45] Date of Patent: Nov. 28, 2000

[54] DIELESS FORMING APPARATUS

[75] Inventors: Jong-Woo Park; Yeh-Sun Hong; Soon-Ho Lim, all of Seoul, Rep. of Korea

[73] Assignee: Korea Institute of Science and Technology, Seoul, Rep. of Korea

[21] Appl. No.: 09/454,769

[22] Filed: Dec. 3, 1999

[30] Foreign Application Priority Data

Jul. 6, 1999 [KR] Rep. of Korea ..... 99/27063

[51] Int. Cl.[7] ..... B21D 11/20

[52] U.S. Cl. ..... 72/57; 72/413; 72/465.1; 72/466.7

[58] Field of Search ..... 72/57, 54, 63, 72/413, 466.7, 465.1

[56] References Cited

U.S. PATENT DOCUMENTS

| | | | |
|---|---|---|---|
| 2,280,359 | 4/1942 | Trudel | 72/413 |
| 2,783,815 | 3/1957 | Tegarden | 72/413 |
| 2,859,719 | 11/1958 | Kraybill | 72/57 |
| 3,056,365 | 10/1962 | Galligan | 72/57 |
| 3,748,889 | 7/1973 | Miller et al. | 72/465.1 |
| 4,212,188 | 7/1980 | Pinson | 72/413 |
| 5,490,407 | 2/1996 | Doose | 72/57 |

OTHER PUBLICATIONS

"Rubber–Pad Forming" (Metals Handbook, 9th edition, vol. 14, ASM, Metals Park, Ohio pp. 605–615).

C.H. Hamilton, "Superplastic Sheet Forming" (Metals Handbook, 9th edition, vol. 14, ASM, Metals Park, Ohio pp. 856–860).

Li Mingzhe, Liu Chunguo and Cai Zhongyi, "A Dieless Forming Technique for Sheet Metal", (Presented at International Conference held in Seoul, Korea on Jul. 8, 1999.

*Primary Examiner*—David Jones
*Attorney, Agent, or Firm*—Darby & Darby

[57] ABSTRACT

The present invention relates to an advanced forming apparatus for sheet blanks such as sheet metals or plastics, and in particular to a multi-purpose and multi-functional forming apparatus which can form sheets into products of various curved surface shape without using a die. The dieless forming apparatus includes an elastomer installed on one side of the sheet blank; a group of punches disposed at the opposite side of the blank, and having ends of various shapes applying a force to the formed material by movement; and a control unit controlling the movement of the press. In addition, a fluid may be filled in substitute for a part of the elastomer to evenly apply a force to the formed material, and a fluid control unit may be included to control a fluid pressure.

8 Claims, 6 Drawing Sheets

DIELESS FORMING APPARATUS

BACKGROUND OF THE INVENTION

1. Field of the Invention

The present invention relates to a forming apparatus for sheet blanks such as sheet metals or plastics. In particular, the present invention relates to a multi-purpose and multi-functional forming apparatus which can form a sheet blank into a product of various curved surface shapes without using a die.

2. Description of the Background Art

In general, a matched die forming method by placing a sheet blank between female and male dies and pressing it with a press has been popularly used as a sheet forming method. Recently, a rubber pad forming apparatus, a hydroforming or fluid forming apparatus and a blow forming apparatus have been developed and used. The rubber pad forming apparatus applies a pressure to a sheet blank on a non-matched single die by means of a rubber and the hydroforming apparatus applies a hydraulic pressure thereto (refer to Metals Handbook, 9th edition, Vol. 14, ASM, Metals Park, Ohio, pp.605~615) and the blow forming apparatus heats a special metal sheet on the die and then deforms it by means of an air pressure (refer to Metals Handbook, 9th edition, Vol. 14, ASM, Metals Park, Ohio, pp.852~860). In addition, a multi-point contact forming apparatus has been developed and used, and this apparatus is provided with a group of steel rods or a matrix-type array of punches as a substitute for a matched-die on the upper and the lower sides of a blank sheet, and controls the height of each element of the punches so as to form a desired curved surface of the sheet (refer to 'A Dieless Forming Technique for sheet metal' by Li Mingzhe et al. presented at International Conference in Seoul, Korea on Jul. 8, 1999). An excessively-large curved surface structure, such as a hull of a ship, may be manually formed, instead of using a forming apparatus.

However, in the conventional methods, a matched die method has disadvantages in that the design and manufacture of dies, especially large-sized dies, require a long term and high cost. Moreover, the dies should be replaced in accordance with the shape of products, and one-part forming process often involves several sets of dies. Additionally, in the case a die is damaged or seriously abraded, further expenses are incurred in repairing or re-fabricating it. Furthermore, the material, thickness and size of the blank for the matched die method is restricted.

As compared with a matched die method, a rubber pad forming apparatus, a hydroforming apparatus and a blow forming apparatus have advantages owing to the non-matched single die in that it is not necessary to use a sheet of a fixed thickness, and that it is quite easy to fabricate and modify the die. However, high expenses are also incurred in fabricating, repairing and modifying the die. Furthermore, in the case of a blow forming apparatus, a special material and a heating operation are required.

To conclude, in the conventional process of matched die forming, blow forming, rubber pad forming and hydroforming, some kinds of dies such as a pair of dies, several sets of matched dies or single die are used and replaced along with every product, which incur high expenses for dies and products. It also takes a long term, in most cases a few months or more, to design and fabricate the dies, and installation of the dies requires additional time whenever products change. Furthermore, the material, thickness and size of the blank sheets are often limited especially for the matched die process.

On the other hand, manual working does not incur expenses for a die, but the working time is quite long, so the productivity is low, and additionally, precision is deteriorated.

A multi-point contact forming apparatus using an array of steel rods or punches can reduce the expenses and time for fabrication and installation of the die, as compared with methods using a die, and has a higher productivity than manual working. However, because the group of steel rods or punches are double configured at the upper and lower parts, the price of the equipment is very high, at least 40% higher than that of the present invention. In addition, it is difficult to precisely control a height of each element of the steel rods or punches on the both sides at the same time. Moreover, a great force is locally applied to the ends of the steel rods or punches which ends are contacted to a point on both surfaces of the blank. Accordingly, especially in the case of a thin sheet, a wrinkle or a caved defect may be easily created at the contacting points of the sheet. In addition, only simple two- or three- dimensional curved surfaces can be formed, and deep drawing is almost impossible.

FIG. 1 is an illustration of force distribution on the punches during the conventional dieless forming process. As shown in FIG. 1 illustrating a distribution of force during the conventional dieless forming, some idle punches 2*a* which do not contribute to the forming occur, resulting in a low efficiency of the press and a low accuracy in forming. The compressive force is also highly concentrated on the contacting points of only non-idle punches 2*b* on the both sides of the sheet, making defects of dimple and wrinkle on the sheet. Thus, a pair of additional elastic spring pads are sometimes required at both sides between the punches and the blank sheet to prevent the defects, although, owing to their own bending limits, the pads restrict the limit of the curvature of the sheet formed. Moreover, as the contacting points of the opposite upper and lower punches are differently dislocated from the central point of the punches on the curved plane as shown in FIG. 1, precise adjustment of each element movement is so difficult that non-uniform deformation and wrinkle often occur in the area between the contacting points. Consequently, application area of the conventional dieless forming is so limited that sheet forming requiring large deformation such as deep drawing is nearly impossible, and only simple curved surfaces can be made.

SUMMARY OF THE INVENTION

It is therefore a primary object of the present invention to provide a dieless forming apparatus which can considerably reduce the cost by using of a press without dies, differently from the matched die forming, and by configuring the press with a group of punches at only one side, differently from the multi-point contact forming apparatus. The apparatus according to the present invention can form a product of various three-dimensional shapes including a large deformation such as deep drawing or stamping, easily control a position of the punches, and form a product of desirable surfaces without creating wrinkles or defects thereon.

It is another object of the present invention to provide a multi-purpose and multi-functional dieless forming apparatus. The apparatus does not require heat or the use of a special material, which is different from a blow forming apparatus, and can be used easily for forming processes of very complicated shapes as well as for a deep drawing process, by using a press having ends of various shapes.

In order to achieve the above-described objects of the present invention, an advanced dieless forming apparatus is provided, the apparatus including: an elastomer installed to support a blank sheet; a press with a group of punches disposed at the opposite side thereof and having ends of various shapes to apply a force thereto by movement; and a control unit to control the movement of the press. According to another embodiment of the present invention, fluid may be filled as a substitute for a part of the elastomer to apply an even repulsive force to the blank during forming. In addition, a fluid control unit may be further included to control the fluid pressure. According to another embodiment of the present invention, a supporting implement may be employed in substitute for a part of the elastomer or the whole elastomer.

BRIEF DESCRIPTION OF THE DRAWINGS

The present invention will become better understood with reference to the accompanying drawings which are given only by way of illustration and thus are not limitative of the present invention, wherein.

DETAILED DESCRIPTION OF THE INVENTION

A dieless forming apparatus in accordance with preferred embodiments of the present invention will now be described with reference to the accompanying drawings.

Figure 2:
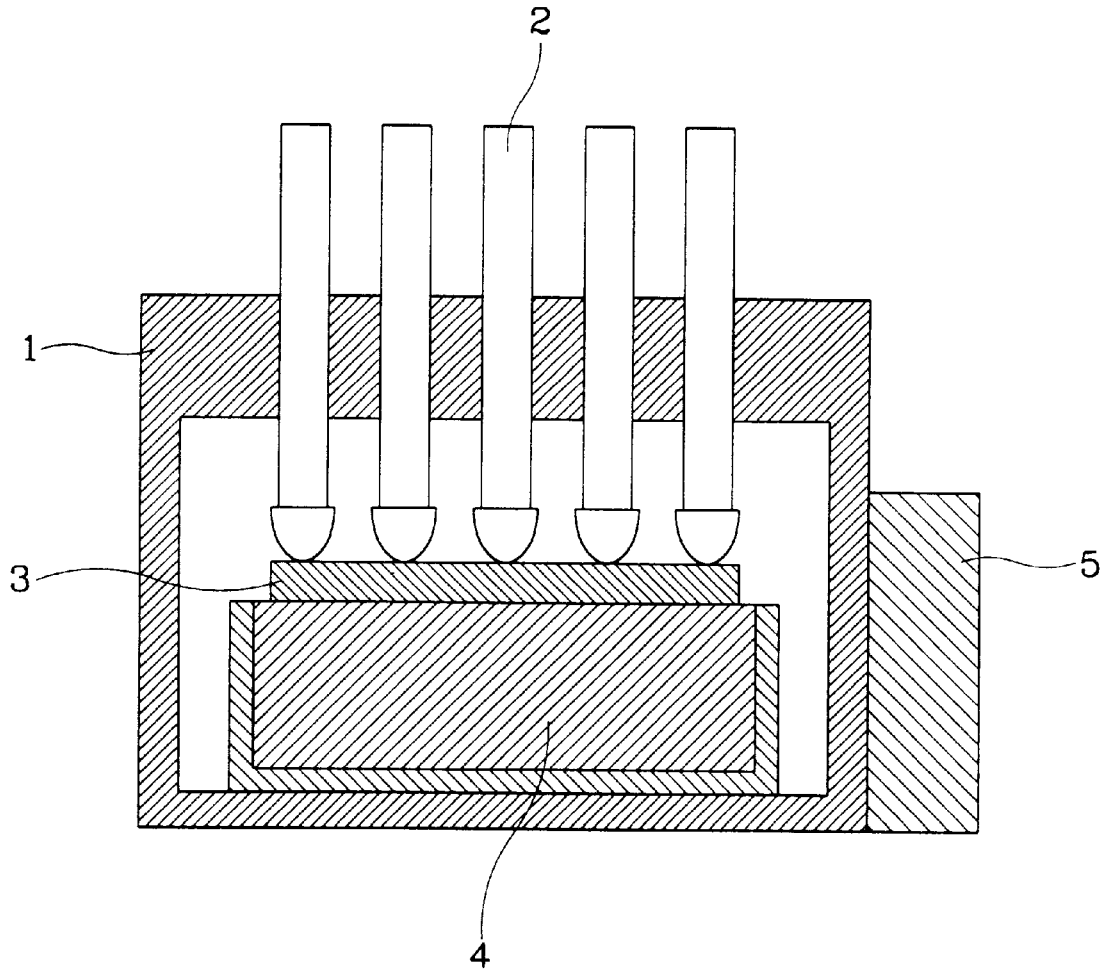
FIG. 2 is a side view illustrating a dieless forming apparatus in accordance with the first embodiment of the present invention.

FIG. 2 is a side view illustrating a dieless forming apparatus in accordance with a preferred embodiment of the present invention. An example of the press 2 is a plurality of punch elements which are arranged, sometimes in a matrix-type array, at an upper portion of a structure 1. A formed blank material 3 is positioned on an elastomer 4 which is arranged at a lower portion thereof. A control unit 5 controlling a movement of the element punches of the press 2 is also arranged nearby.

Figure 3:
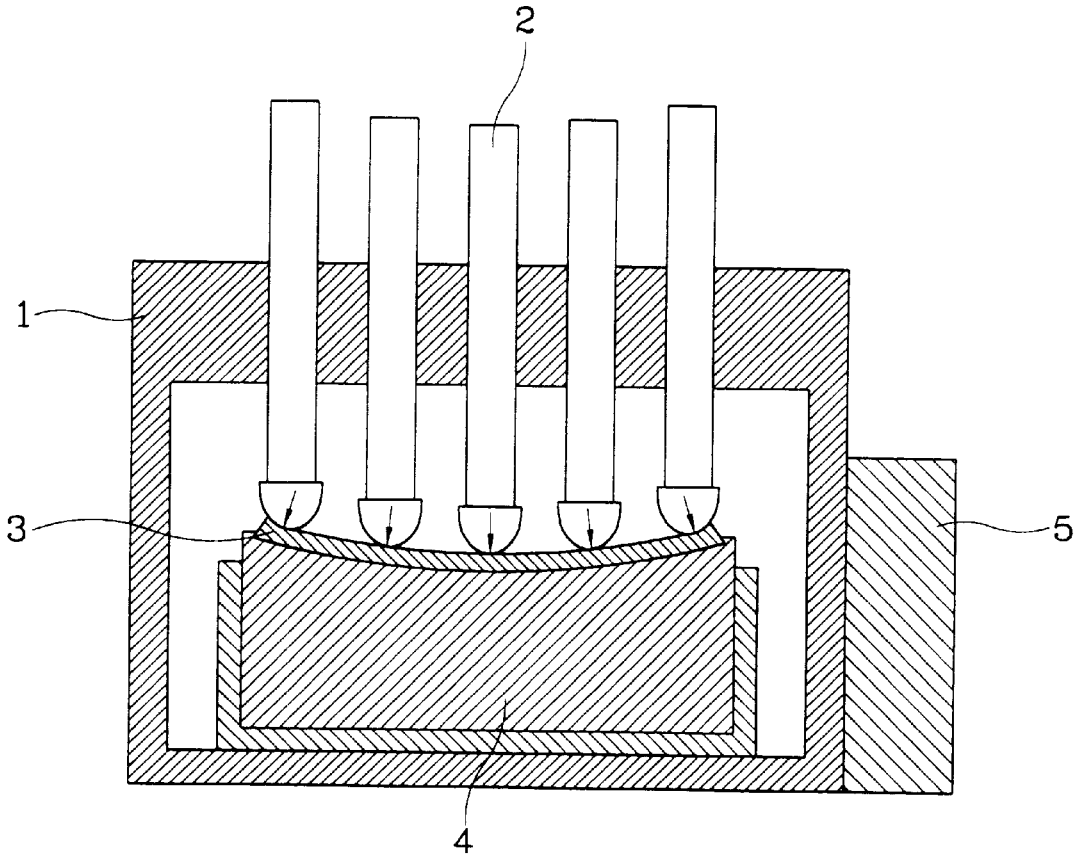
FIG. 3 shows a dieless forming process by the dieless forming apparatus as shown in FIG. 2.

FIG. 3 illustrates a dieless forming process by the forming apparatus as shown in FIG. 2. As shown therein, the blank material 3 is positioned on the elastomer 4. Thereafter, the elements of the press 2 are respectively or simultaneously moved to intended positions by the control unit 5, whereby applying a force to the blank 3. The elastomer 4 generates a repulsive force supporting the formed material 3. The blank material 3 is deformed to have various curved shapes according to the connecting lines of the ends of elements in the press 2. The elements of the press 2 may have ends of various shapes. The ends may be fixed to the elements of the press 2 or replaced in accordance with a desired shape of the products, and this will be described later with reference to FIG. 6. Thereafter, when the elements of the press 2 return upward, the formed material 3 is also pushed upward by a restoration movement of the elastomer 4. In this way, a forming process can be consecutively performed producing various shapes of products through repeatedly carrying out the above-described steps, without using a die. In addition, in the case that a formed product is long in length, the formed material 3 is longitudinally moved, whereby the forming process is performed step by step. The positions of the press 2 and the elastomer 4 may be interchanged. In addition, the press 2 and the elastomer 4 may be configured at the right and left sides of the structure 1 respectively, or vice versa. Furthermore, the shape, number, size, interval, arrangement and force of the punches in the press 2 and the type, size, shape, material, structure, constitution and arrangement of the elastomer may be selected to be adapted to the intended purposes.

According to the conventional multi-point contact forming apparatus previously-mentioned above, the forming process is performed with two groups, the upper and lower groups, of punches being simultaneously moved toward both surfaces of a formed material. Accordingly, it is difficult to precisely control positions of the punches at both sides. Even when the punches are slightly missed from each other, defects such as a wrinkle and a dimple may be easily created. However, in accordance with the present invention, only one group of the punches in the press 2 is moved toward one side of the formed material 3 and then apply a force thereto, and the elastomer 4 is automatically adjusted according to deformation of the formed material 3 on the other side thereof, whereby precise control of the present invented system is easy. Furthermore, while, according to the multi-point contact forming apparatus, the punches are point-contacted with both sides of the formed material, the elastomer 4 of the present invention is face-contacted with one side of the formed material 3 instead of the punches, and thus evenly distributes force to the entire formed material 3. As a result, the formed material 3 can be uniformly deformed. It is also noteworthy that the price of the present equipment is mach lower than that of the conventional equipment because, at one side, the elastomer, which is very cheap, is substituted for a group of punches and the control system, which are very expensive and difficult to make. In addition, the elastomer can be installed promptly, and controlled easily by its own repulsive action, compared to punches.

Figure 4:
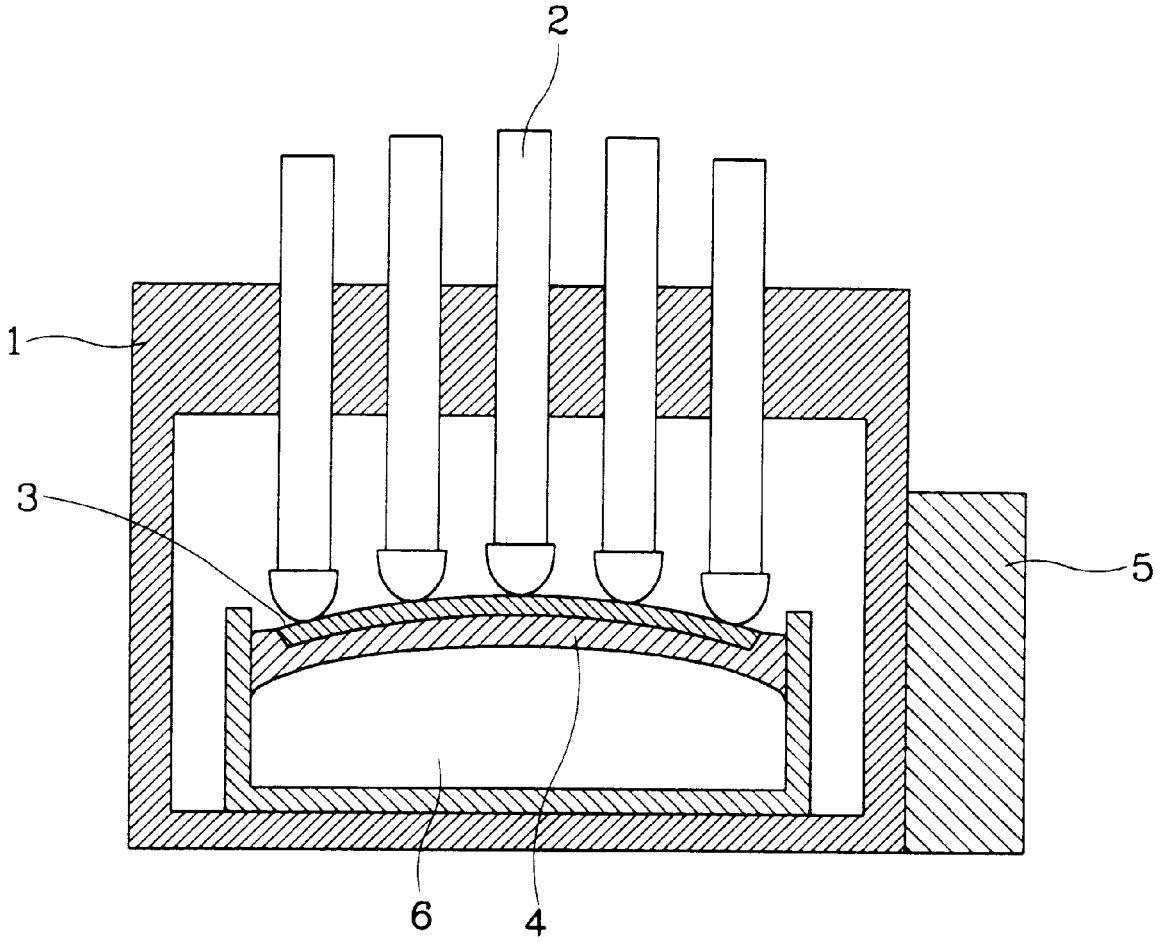
FIG. 4 is a side view illustrating a dieless forming apparatus in accordance with the second embodiment of the present invention.

FIG. 4 illustrates a dieless forming apparatus in accordance with another embodiment of the present invention. The elastomer 4 has a smaller thickness, and fluid 6 is filled below the elastomer 4. When the press 2 press the formed material 3, the fluid 6 is deformed together with the elastomer 4, and then the pressure of the fluid 6 is evenly distributed to the elastomer 4 according to the Pascal's principle. Therefore, the pressure may be evenly applied to the formed material 3. The pressure of the fluid 6 may be increased or decreased by using an optional fluid pressure control unit, in accordance with a magnitude of a forming pressure determined by the thickness of the formed material 3 and the shape of the formed product.

Figure 5:
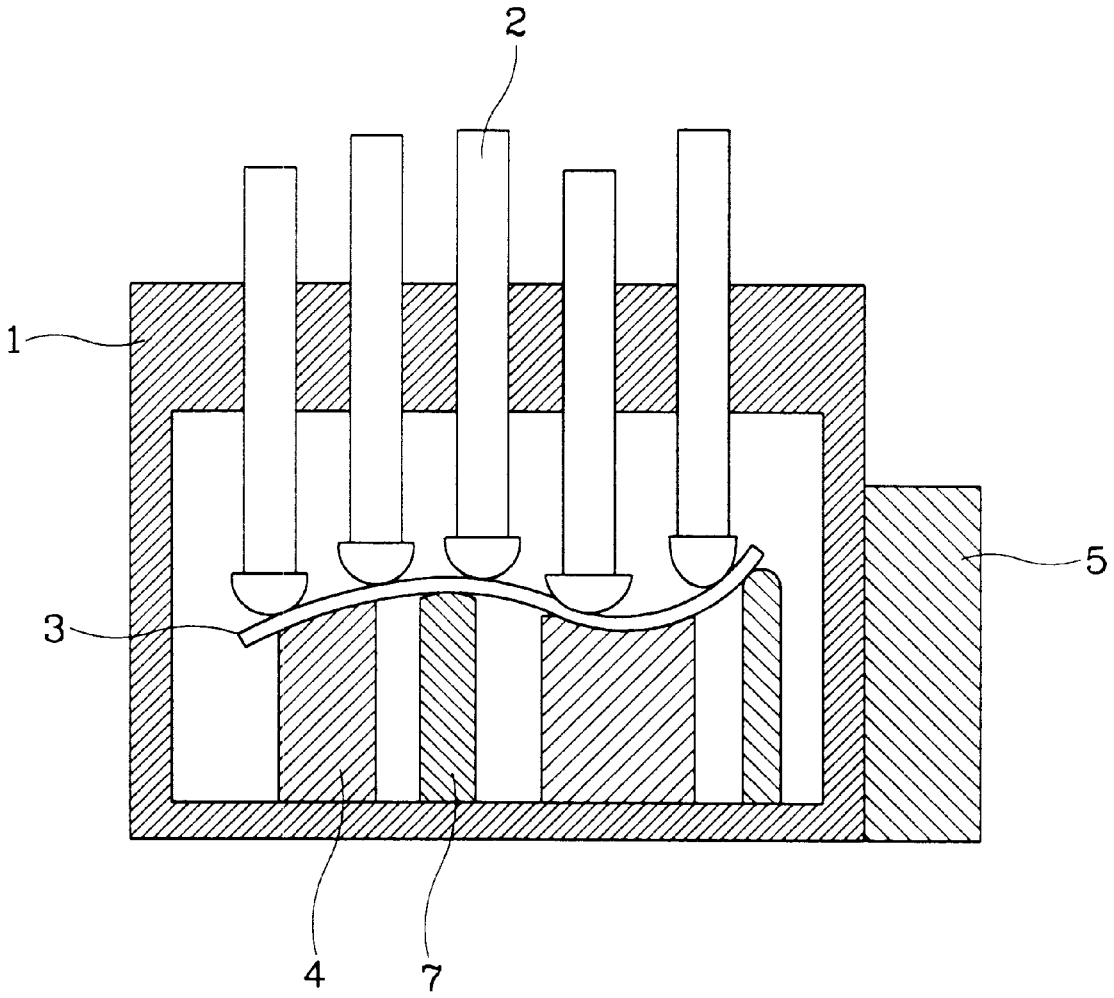
FIG. 5 is a side view illustrating a dieless forming apparatus in accordance with the third embodiment of the present invention.

FIG. 5 illustrates a dieless forming apparatus in accordance with yet another embodiment of the present invention. As shown therein, supporting implements 7 of a metal or a high-strength material may be used in substitute for the elastomer 4. The supporting implements 7 support part of a load applied to the elastomer 4. Therefore, the elastomer 4 is decreased in size and the elastomer 4 having a smaller compression strength may be employed. Accordingly, the total repulsive force from the elastomer 4 is reduced, and thus the forming force is decreased. As a result, the price of the equipment can be further reduced. Especially, the supporting implements 7 are effective to form a product of a large-sized plate having a simple curved surface. In some cases, the supporting implements 7 can be used in substitute for the whole elastomer 4.

Figure 6:
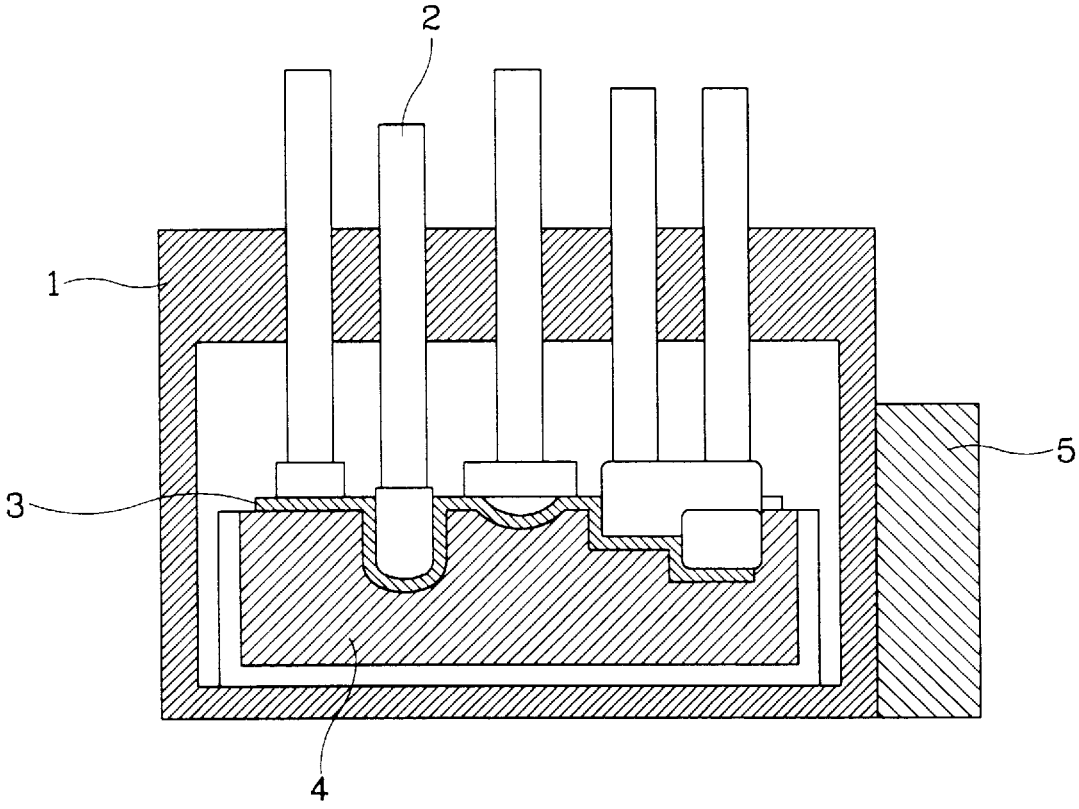
FIG. 6 is a side view illustrating a forming apparatus using a press having ends of various shapes, according to the fourth embodiment of the present invention.

FIG. 6 illustrates a forming apparatus wherein the ends of the punches have various shapes. The forming apparatus in accordance with the present invention may be used for a stamping process or a deep drawing process characterized by a large amount of deformation or a complicated shaped surface of a product. As shown in FIG. 6, the press 2 having ends of various shapes presses the formed material 3 on the elastomer 4, thereby forming a formed material into a product of complicated shapes. Here, as described above, the ends of the elements in the press 2 can be replaced according to a desired shape of a product. In the case of a deep drawing process, some elements of the press 2 prevents a wrinkle from be created. In other words, if only one punch presses the formed material 3, a wrinkle is created around the contacting area of the punch with a blank. According to the present invention using a plurality of the punches, however each punch applies a proper magnitude of force to the formed material 3 to prevent a wrinkle which may be created by punching of another nearby punch. As a result, a wrinkle is not created, and a product is evenly formed. Here, any of the above-described structures of the forming apparatus in accordance with the present invention can be employed.

As discussed earlier, in the present invention, a variety of curved surfaces can be formed immediately without making and changing dies, and the kind and thickness of the blank 3 is not restrictive. A long curved surface of a partially different shape can also be rapidly made by successively moving the formed blank 3 along in length.

Figure 1:
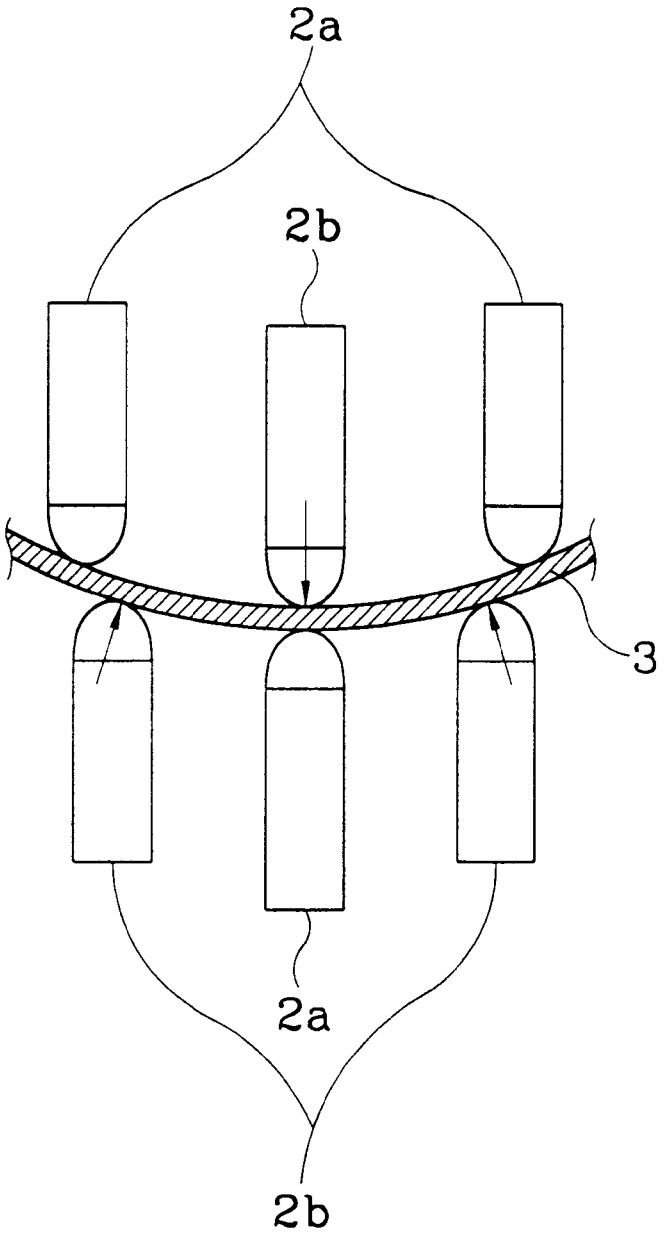
FIG. 1 CONVENTIONAL ART
FIG. 1 is an illustration of force distribution on the punches during the conventional dieless forming process.

In addition, the forming apparatus according to the present invention can form various two- and three-dimensional curved surfaces even with complex shapes. Differently from the conventional multi-point contact forming apparatus, the group of punches in the present system is arranged merely at one side of the formed material, and the elastormer is provided at the other side thereof, which reduces expenses of the equipment by more than a third. Additionally, it is possible to easily control the position of the element punches, and there are no idle punches as shown by the force distribution on the punch ends of press 2 in FIG. 1. As a result, a high efficiency of all the punches and a high accuracy in the forming can be achieved. Besides, as the forming force distributes evenly on all the punches and the contacting plane of the elastomer, the product is uniformly formed with a favorable surface state, and an exquisite shape can be formed. Consequently, the dieless forming in accordance with the present invention is a highly advanced multi-purpose and multi-functional technology having various excellent advantages and a technical innovation.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. A dieless apparatus for forming a blank of material comprising:

a press located on one side of the apparatus with a plurality of punches to be moved individually or in a group for applying a force on a surface of one side of the blank of material opposing the press;

an elastomer member located on the other side of the press to support the opposite side of the blank of material and to deform in response to force applied by said punches to said one side, and a control unit for controlling the movement of the press.

2. The apparatus of claim 1, wherein the punches have various end shapes and sizes to engage the blank of material.

3. The apparatus of claim 1 further comprising a fluid filled in a portion of said elastomer member.

4. The apparatus of claim 3 further comprising a fluid control unit for controlling pressure of the fluid.

5. A dieless apparatus for forming a blank of material comprising:

a press located on one side of the apparatus with a plurality of punches which can move individually or in a group for applying a force on a surface of said one side of said blank of material;

an elastomer member and a supporting implement located on the other side of the press to support the opposite side of the bank of material and to deform as force as applied by said punches to said one side; and a control unit for controlling the movement of the punches of the press.

6. The apparatus of claim 5, wherein said punches have various end shapes and sizes.

7. The apparatus of claim 5, further comprising a fluid filled in a portion of said elastomer member.

8. The apparatus of claim 7 further comprising a control unit for controlling pressure of the fluid.

* * * * *